US011720056B2

(12) United States Patent
Shuhama

(10) Patent No.: US 11,720,056 B2
(45) Date of Patent: Aug. 8, 2023

(54) IMAGE FORMING APPARATUS HAVING FAN TO SUCK AIR INTO THE IMAGE FORMING APPARATUS

(71) Applicant: CANON KABUSHIKI KAISHA, Tokyo (JP)

(72) Inventor: Yu Shuhama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/507,641

(22) Filed: Oct. 21, 2021

(65) Prior Publication Data

US 2022/0128948 A1 Apr. 28, 2022

(30) Foreign Application Priority Data

Oct. 28, 2020 (JP) ..... 2020-180573

(51) Int. Cl.
*G03G 21/20* (2006.01)
*G03G 21/16* (2006.01)
*G03G 15/00* (2006.01)

(52) U.S. Cl.
CPC ..... *G03G 21/206* (2013.01); *G03G 15/80* (2013.01); *G03G 21/1652* (2013.01); *G03G 21/1671* (2013.01)

(58) Field of Classification Search
CPC .. G03G 21/206; G03G 15/80; G03G 21/1652; G03G 21/1671; G03G 2221/1645
See application file for complete search history.

(56) References Cited

U.S. PATENT DOCUMENTS

2014/0314437 A1* 10/2014 Nishida ..... G03G 21/206 399/92
2016/0070231 A1* 3/2016 Kobayashi ..... G03G 21/206 399/92
2017/0017199 A1* 1/2017 Tanaka ..... G03G 21/206
2019/0307013 A1* 10/2019 Hashizume ..... G03G 15/80

FOREIGN PATENT DOCUMENTS

JP 2004272089 A 9/2004
JP 2009271237 A 11/2009
JP 2013186322 A 9/2013
JP 2017044817 A 3/2017
JP 2017090480 A 5/2017

* cited by examiner

*Primary Examiner* — Sandra Brase
(74) *Attorney, Agent, or Firm* — Canon U.S.A., Inc. I.P. Division

(57) ABSTRACT

An image forming apparatus includes an image forming unit, a stacking unit, a frame, an outer surface member, an electronic circuit board, and a fan. The image forming unit, supported by the frame, forms an image on a recording material that then is stacked on the stacking unit. The outer surface member is disposed on an outer side relative to the frame and includes a through-hole. The electronic circuit board is disposed between the frame and the outer surface member. The fan sucks air from an outside to an inside of the image forming apparatus via the through-hole. The electronic circuit board is disposed on an upstream side of the fan in a direction of an air flow generated into air by the fan. The stacking unit is disposed on a downstream side of the fan in the direction of the air flow generated by the fan.

14 Claims, 9 Drawing Sheets

IMAGE FORMING APPARATUS HAVING FAN TO SUCK AIR INTO THE IMAGE FORMING APPARATUS

BACKGROUND

Field

The present disclosure relates to an image forming apparatus that forms and fixes an image on a recording material.

Description of the Related Art

An image forming apparatus such as a laser beam printer includes many fans, most of which are used for the purpose of cooling.

Examples of targets that require cooling include an electronic circuit board that converts alternating-current (AC) power from an external outlet into a current and voltage to be used by an image forming apparatus, an electronic component such as a motor that generates heat, heat generated by frictions in a drive unit, a toner fixing unit, and a recording material that has passed through the toner fixing unit.

For example, Japanese Patent Application Laid-Open No. 2017-44817 discloses a configuration for sending air to an electronic circuit board by using a fan to cool the electronic circuit board.

In conventional configurations where a fan is disposed for each individual purpose, a plurality of fans is required to send air to the inside of an image forming apparatus, resulting in an increase in size of the image forming apparatus.

SUMMARY

According to an aspect of the present disclosure, an image forming apparatus includes an image forming unit configured to form an image on a recording material, a stacking unit on which the recording material having the image formed thereon by the image forming unit is stacked, a frame configured to support the image forming unit, an outer surface member disposed on an outer side relative to the frame and having a through-hole, an electronic circuit board disposed between the frame and the outer surface member, and a fan configured to suck air from an outside of the image forming apparatus to an inside of the image forming apparatus via the through-hole, wherein the electronic circuit board is disposed on an upstream side of the fan in a direction of an air flow generated into air by the fan, and wherein the stacking unit is disposed on a downstream side of the fan in the direction of the air flow generated by the fan.

Further features of the present disclosure will become apparent from the following description of exemplary embodiments with reference to the attached drawings.

DESCRIPTION OF THE EMBODIMENTS

A first exemplary embodiment of the present disclosure will be described below.

(Image Forming Apparatus)

Figure 1:
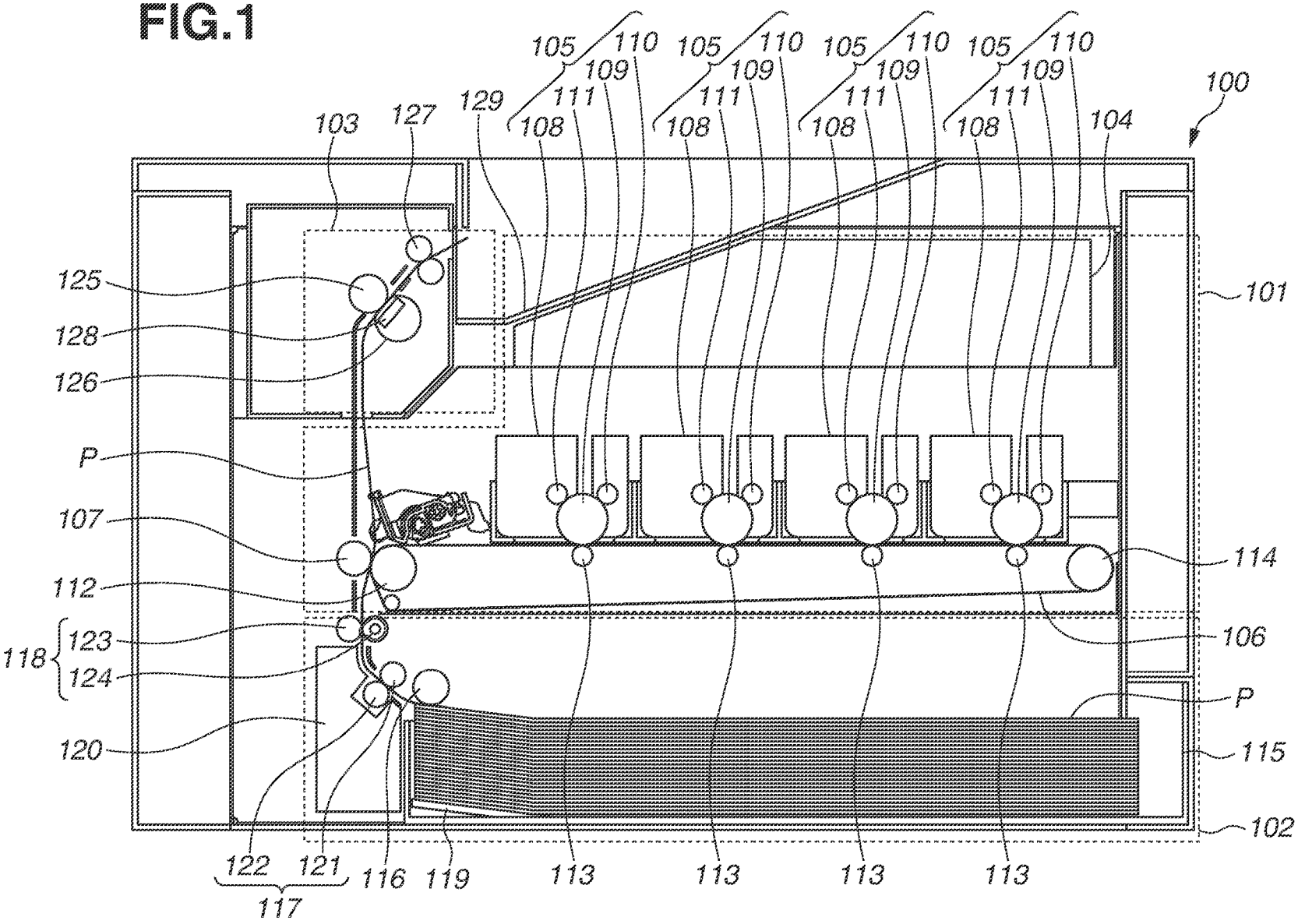
FIG. 1 is a cross-sectional view illustrating an image forming apparatus according to a first exemplary embodiment.

FIG. 1 is a schematic view illustrating a color laser beam printer as an example of an image forming apparatus 100. In a configuration of the image forming apparatus 100, by rotating a cartridge door 100*a* to be opened and pulling a cartridge support member 100*b* that supports a plurality of cartridges 105 out from the inside of the image forming apparatus 100, the cartridges 105 can be replaced. In the following description, a face of the image forming apparatus 100 where the cartridge door 100*a* is disposed is referred to as the front face, a face opposite the front face is referred to as the rear face, and a direction in which the front and rear faces oppose each other is referred to as an anteroposterior direction. When the image forming apparatus 100 is viewed from a direction facing the front face, a side face on the right-hand side is referred to as the right face, and a side face on the left-hand side is referred to as the left face.

The image forming apparatus 100 includes an image forming unit 101, a recording material supply unit 102, and a fixing unit 103. The image forming unit 101 includes at least the cartridges 105. In the present exemplary embodiment, the image forming unit 101 includes a laser scanner 104, the cartridges 105, an intermediate transfer belt 106, and a secondary transfer roller 107. The laser scanner 104 is configured to irradiate each of the cartridges 105 with a laser beam.

The cartridge 105 includes a toner container 108 that stores a toner, a photosensitive drum 109 irradiated with a laser beam from the laser scanner 104, a charging roller 110 that charges the photosensitive drum 109, and a developing roller 111 that applies toner to the photosensitive drum 109. In the present exemplary embodiment, the image forming unit 101 includes four cartridges 105. Each of the four cartridges 105 stores a yellow, a magenta, a cyan, or a black toner and is disposed perpendicularly below the laser scanner 104.

The intermediate transfer belt 106 is disposed perpendicularly below the four cartridges 105. The intermediate transfer belt 106 is an endless belt. The intermediate transfer belt 106 is supported by a belt drive roller 112, primary transfer rollers 113, and a tension roller 114 that are disposed on the inner side of the intermediate transfer belt 106. The intermediate transfer belt 106 is given tension by the tension roller 114 and is rotatable as drive is transmitted from the belt drive roller 112. Four primary transfer rollers 113 are in contact with respective photosensitive drums 109 of the four cartridges 105 across the intermediate transfer belt 106 at a predetermined pressure. The secondary transfer roller 107 is disposed to face the belt drive roller 112 across the intermediate transfer belt 106 and is in contact with the intermediate transfer belt 106 at a predetermined pressure.

The recording material supply unit 102 includes a storage tray 115, a supply roller 116, a separation unit 117, and a conveyance unit 118. The storage tray 115, which is a storage unit for storing recording materials P, is configured to be attachable to and detachable from the image forming apparatus 100 by being drawn out toward the front side. The storage tray 115 is provided with a lift plate 119 that moves up and down depending on the number of stacked recording materials P. The supply roller 116 is disposed at a position facing the storage tray 115 across the stacked recording materials P. The separation unit 117 is disposed in a conveyance guide 120 and on the downstream side of the supply roller 116, and includes a conveyance roller 121 and a separation roller 122. The conveyance roller 121 and the separation roller 122 are each provided with a rubber member on a surface thereof. The separation roller 122 having a built-in torque limiter is configured to generate predetermined load torque. The separation roller 122 is in contact with the conveyance roller 121 at a predetermined pressure. When the conveyance roller 121 is driven, the separation roller 122 is driven while generating predetermined load torque on the conveyance roller 121. The conveyance unit 118 is disposed on the downstream side of the separation unit 117 and on the upstream side of a nip portion of the secondary transfer roller 107. The conveyance unit 118 includes a registration roller pair 123 and a shutter member 124. The shutter member 124 is configured to be rotatable with a predetermined load and is disposed on the upstream side of the nip portion of the registration roller pair 123. The fixing unit 103 includes a fixing roller 125, a pressure heat member 126, and a discharge roller pair 127. The fixing roller 125 is disposed on the downstream side of the secondary transfer roller 107 and is in contact with the pressure heat member 126 at a predetermined pressure. The pressure heat member 126 includes a heating member 128. The discharge roller pair 127 is disposed on the downstream side of the fixing roller 125.

(Image Forming Operation)

When a print signal is input, the image forming apparatus 100 starts a printing operation. The laser scanner 104 irradiates surfaces of the four photosensitive drums 109 with a laser beam based on image information to be printed. The surface of each photosensitive drum 109 is charged by the charging roller 110, and an electrostatic latent image is formed on the surface of the photosensitive drum 109 with the radiated laser beam. The electrostatic latent image on the surface of the photosensitive drum 109 is supplied with toner by the developing roller 111 and then developed to generate a toner image. The toner image generated on the surface of the photosensitive drum 109 is transferred onto the intermediate transfer belt 106 by a voltage applied to a corresponding primary transfer roller 113. While toner images are being transferred from the cartridges 105 to the intermediate transfer belt 106, the intermediate transfer belt 106 is driven by the belt drive roller 112 and conveys the toner images to the nip portion of the secondary transfer roller 107. In parallel with the above-described operation, the supply roller 116 in the recording material supply unit 102 conveys a recording material P stacked on the storage tray 115 to the separation unit 117. If a plurality of recording materials P is conveyed to the separation unit 117, one recording material P is separated by the load torque of the separation roller 122 at the nip portion and then conveyed to the conveyance unit 118. In the conveyance unit 118, a leading edge of the recording material P comes in contact with the shutter member 124. Since the shutter member 124 is provided with a predetermined rotational load, the recording material P pushes the shutter member 124 aside and enters the nip portion of the registration roller pair 123 while forming a loop by a conveyance force of the separation unit 117. If the recording material P skews, the leading edge of the recording material P obliquely in contact therewith is made straight with respect to the shutter member 124 by the loop formed before being held by the registration roller pair 123, thus the skew is corrected. The recording material P that has passed the registration roller pair 123 is conveyed to the nip portion formed between the secondary transfer roller 107 and the belt drive roller 112 at a controlled conveyance speed. At the nip portion, the toner images conveyed by the intermediate transfer belt 106 are transferred onto the recording material P. The recording material P with the toner images transferred thereon is conveyed to a contact portion between the fixing roller 125 and the pressure heat member 126. When the recording material P is pressed and heated, toner melts and is fixed on the surface. Then, the recording material P is discharged to the outside of the apparatus by the discharge roller pair 127 and then sequentially stacked on a discharge tray 129 disposed on the top surface of the apparatus.

(Outer Surface Members)

Figure 2:
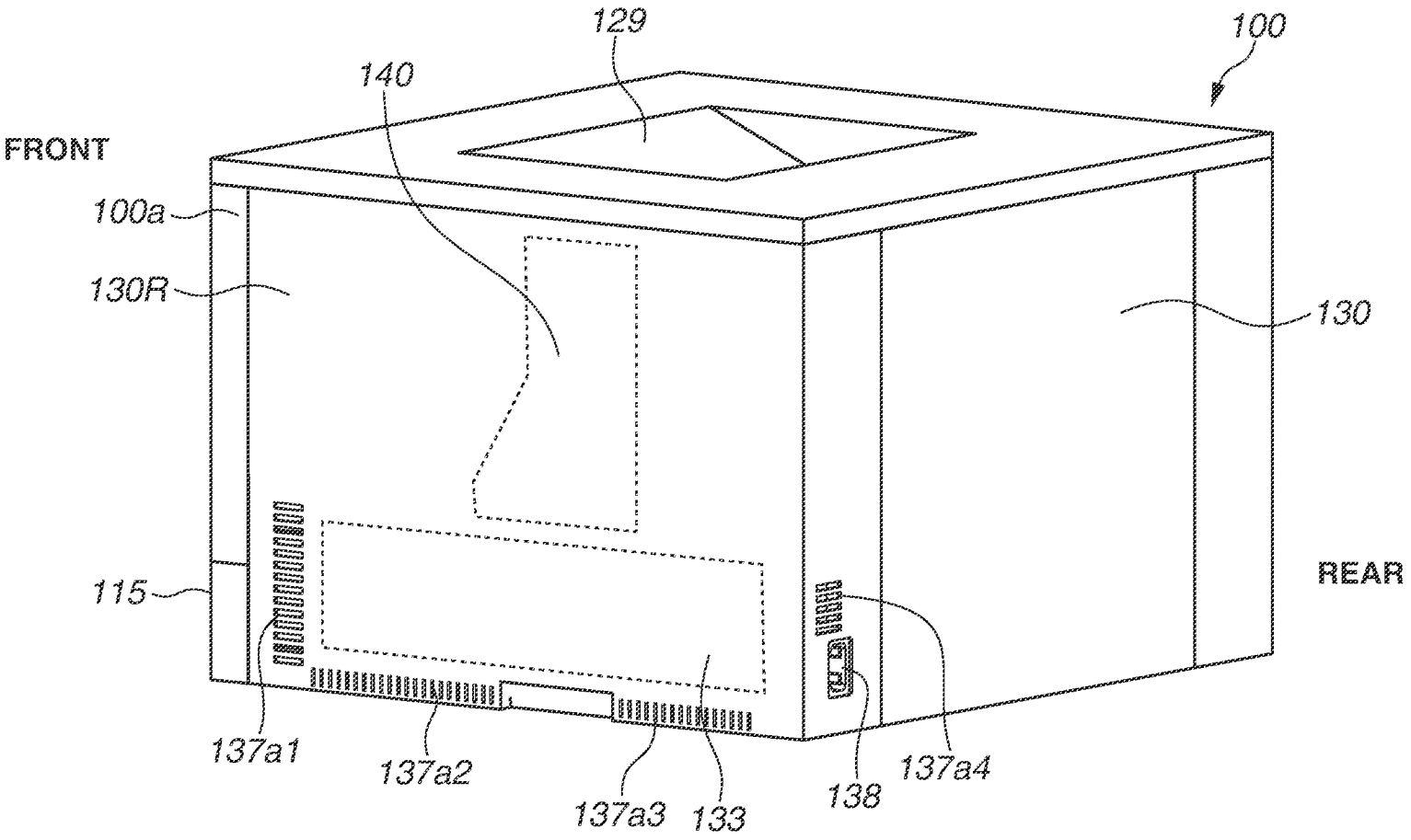
FIG. 2 is a perspective view illustrating the image forming apparatus according to the first exemplary embodiment.

FIG. 2 is a perspective view illustrating the image forming apparatus 100. An outer surface member 130 is disposed on a side face (right side face) of the image forming apparatus 100. The outer surface member 130 is provided with a handle, louvers 137 (137*a*1 to 137*a*4), and an inlet opening 130*a*. The handle is formed on the outer surface member 130 in the vicinity of the center of the image forming apparatus 100 in the anteroposterior direction, as an inwardly recessed portion of a portion continuous to the bottom surface of the image forming apparatus 100. Although not illustrated, another handle is similarly disposed on another outer surface member 130 on the opposite side of the image forming apparatus 100. By a user hooking his/her fingers into the handles on both sides of the image forming apparatus 100, the image forming apparatus 100 can be lifted up. The handles are positioned in consideration of the center of gravity of the image forming apparatus 100 so that the apparatus orientation remains stable when lifted up. The plurality of louvers 137 are provided on both sides of the handle in the anteroposterior direction of the image forming apparatus 100. More specifically, the outer surface member 130 has a plurality of through-holes disposed via the louvers 137. Air can be drawn into the apparatus via the plurality of through-holes. The inlet opening 130*a*, which enables a power cord to be plugged into the image forming apparatus 100, is disposed on the rear face, which is adjacent to and orthogonal to the side faces on which the handles and the louvers 137 are disposed, of the outer surface members 130. The inlet opening 130*a* is formed so that an inlet 138 disposed in a power supply unit 133 (described below) is exposed on the inside. The image forming apparatus 100 is supplied with power when the power cord connected to a commercial power supply is plugged into the inlet 138.

Figure 3:
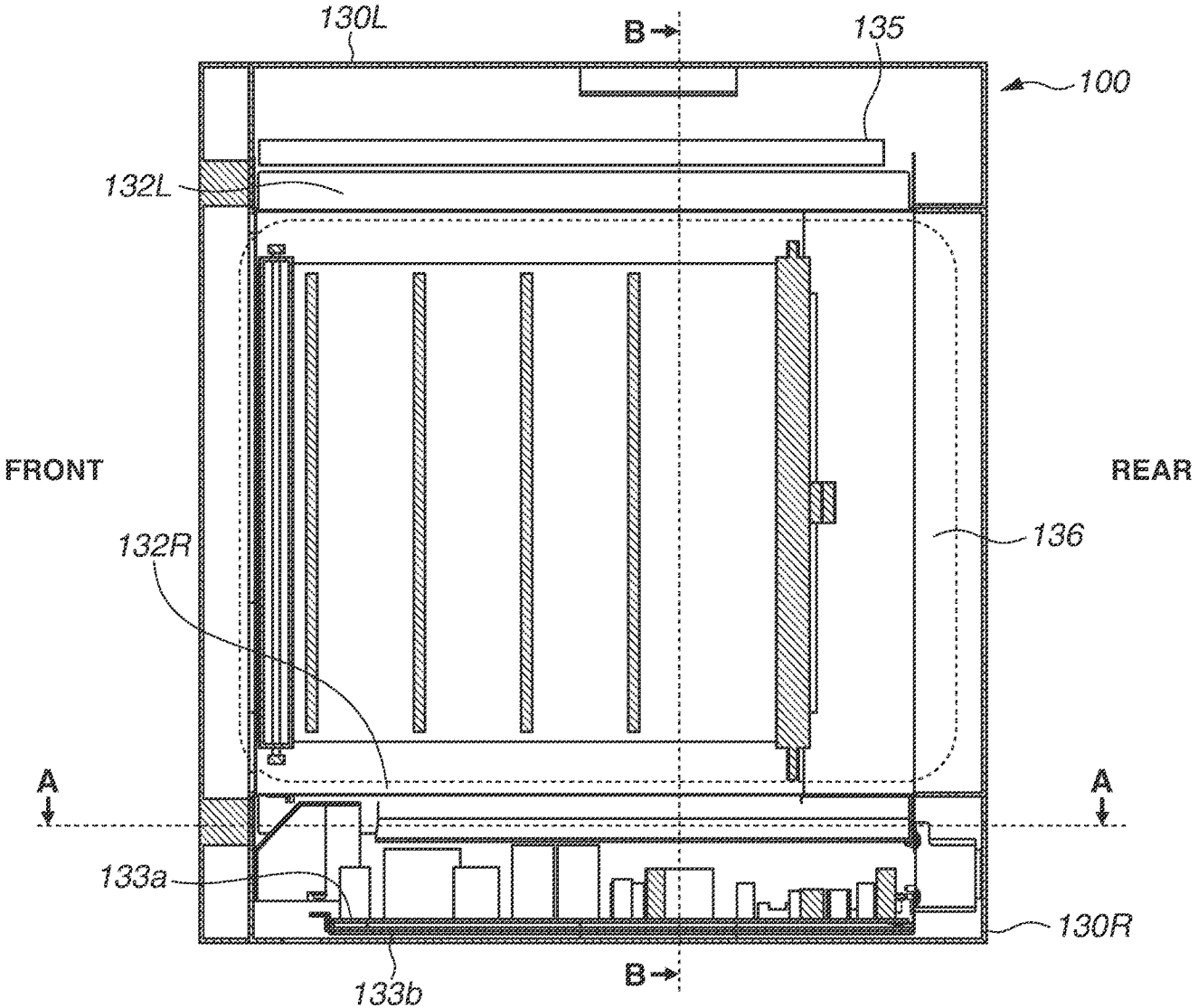
FIG. 3 is a horizontal cross-sectional view illustrating the image forming apparatus according to the first exemplary embodiment.
Figure 4:
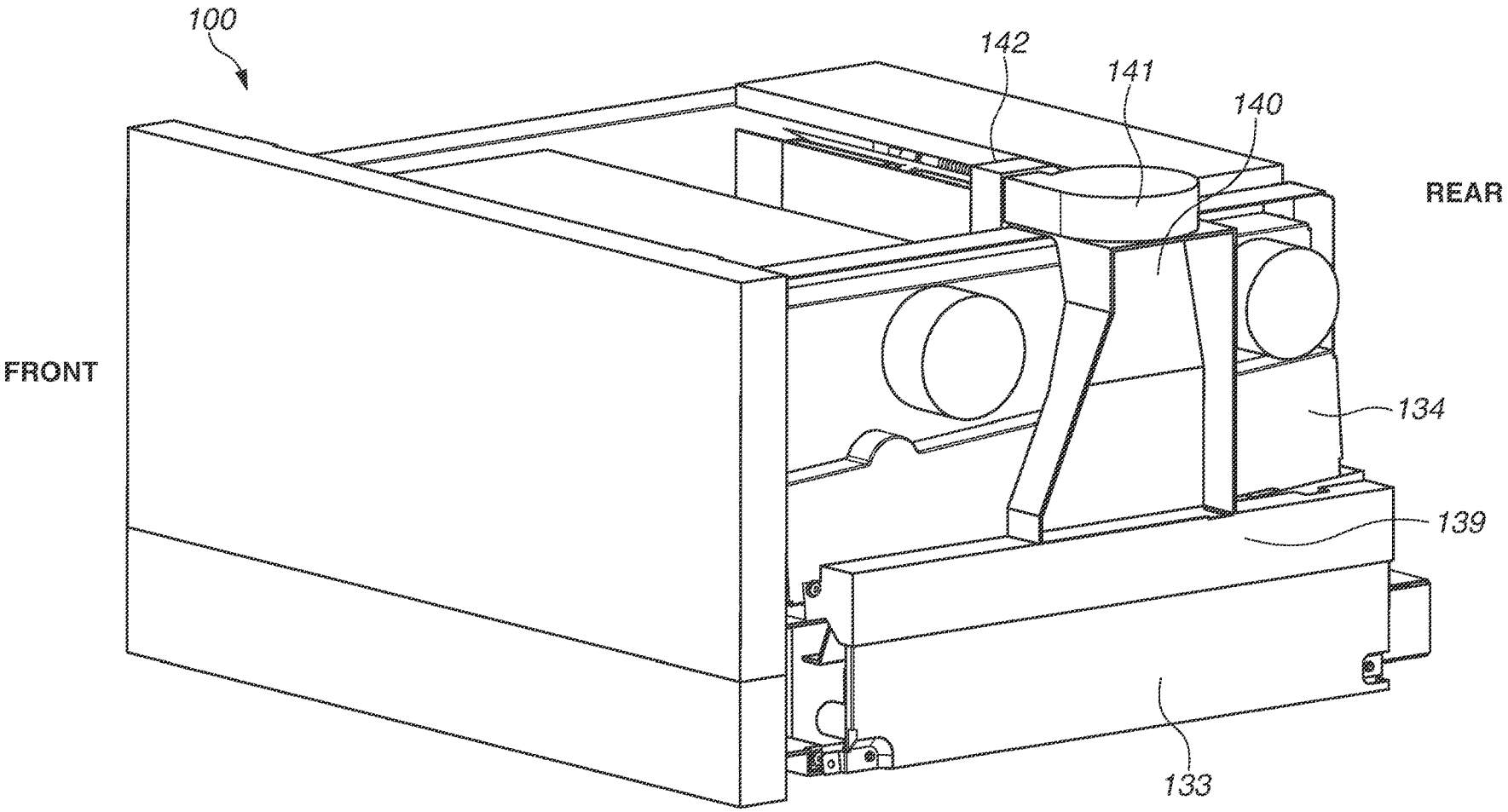
FIG. 4 is an exploded perspective view illustrating the inside of the image forming apparatus according to the first exemplary embodiment.
Figure 5:
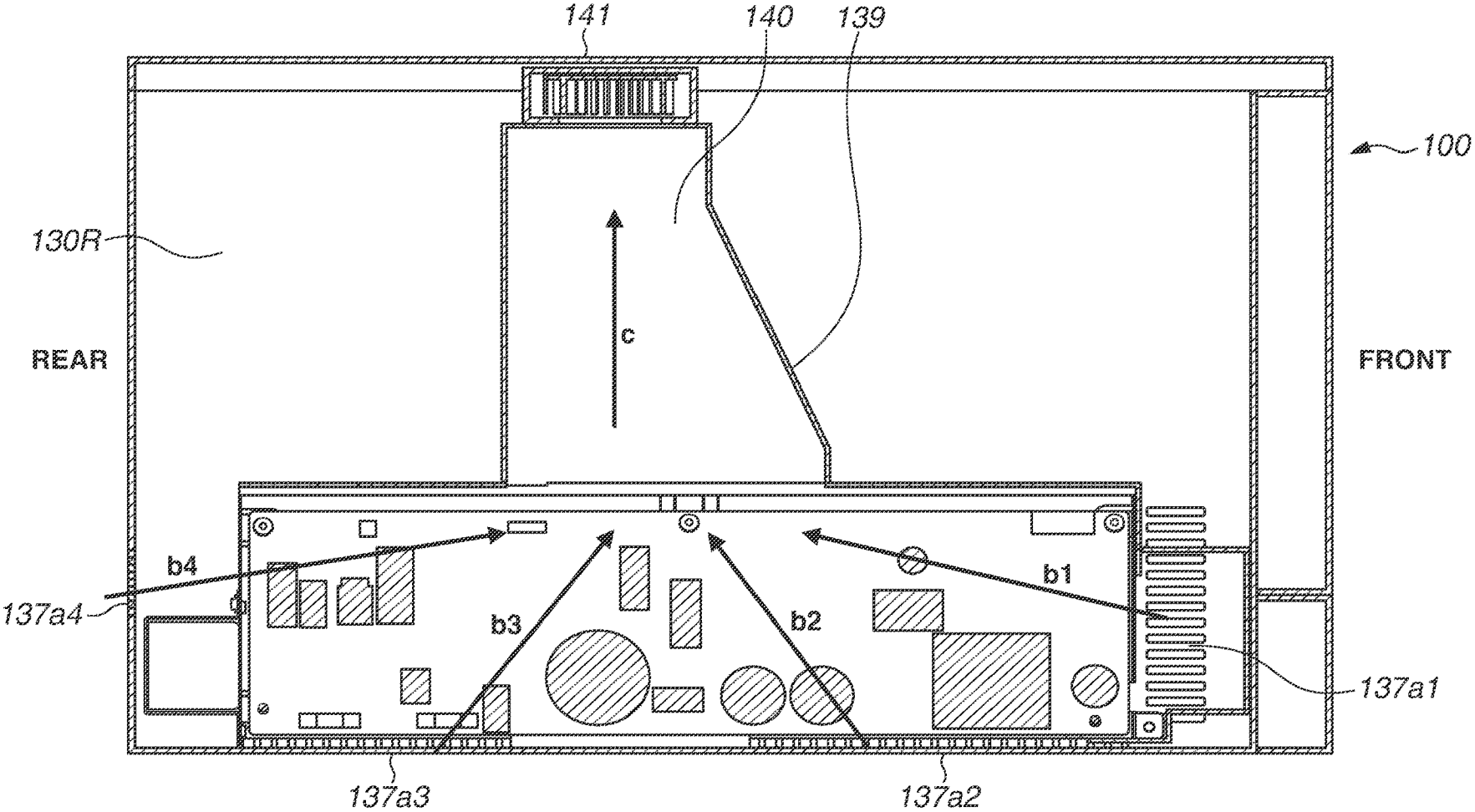
FIG. 5 is a side view illustrating the inside of the image forming apparatus according to the first exemplary embodiment.
Figure 6:
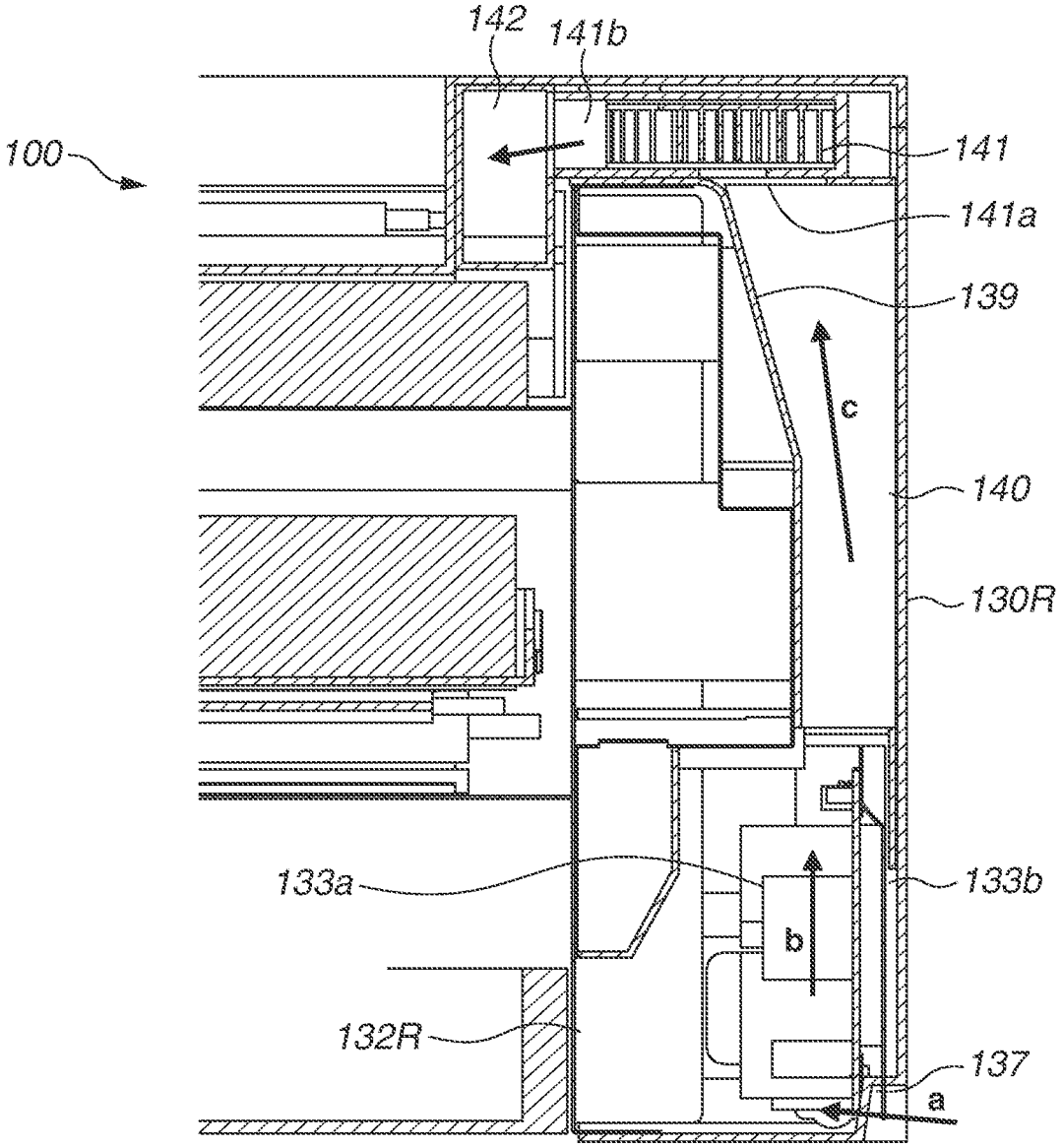
FIG. 6 is a partial cross-sectional view illustrating the inside of the image forming apparatus according to the first exemplary embodiment.
Figure 7:
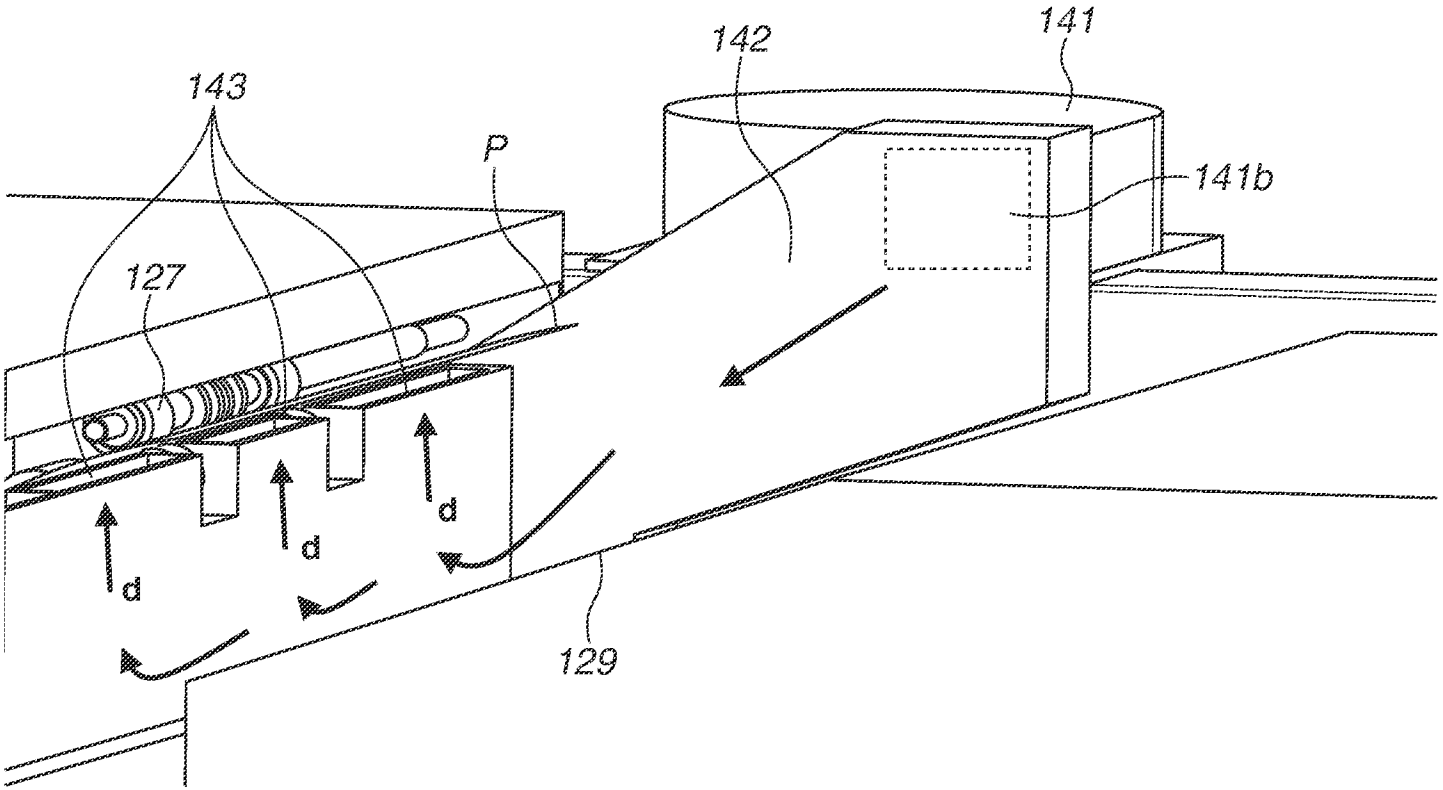
FIG. 7 is an exploded perspective view illustrating a configuration in the vicinity of a sheet discharge unit of the image forming apparatus according to the first exemplary embodiment.

An internal structure and arrangement of components of the image forming apparatus 100 will be described below with reference to FIGS. 3 to 7. FIG. 3 is a horizontal cross-sectional view illustrating the image forming apparatus 100. FIG. 4 is a front right perspective view illustrating the image forming apparatus 100 when the outer surface members 130 on the right, left, and rear faces are removed. FIG. 5 is a vertical cross-sectional view illustrating the vicinity of a power circuit board 133*a* taken along the line A-A in FIG. 3. FIG. 6 is a vertical cross-sectional view illustrating the vicinity of a blower apparatus 141 taken along the line B-B in FIG. 3. FIG. 7 is an enlarged view illustrating the vicinity of a sheet ejection opening when the outer surface members 130 on the right and left side faces are removed.

An image formation unit 136 including the image forming unit 101, the recording material supply unit 102, and the fixing unit 103 is disposed at the center of the image forming apparatus 100. In the image forming apparatus 100, a framework 132 having a right framework 132R and a left framework 132L is disposed to sandwich the image formation unit 136 from the right and left sides to support the image formation unit 136.

The power supply unit 133 and a drive unit 134 including motors and gears for driving the rollers of the image formation unit 136 are disposed outside the right framework 132R. More specifically, the outer surface member 130 and the right framework 132R are disposed to face each other, and the drive unit 134 is attached to the right framework 132R between the outer surface member 130 and the right framework 132R. On a right outer surface member 130R, the louvers 137*a*1 and 137*a*4 are arranged along the two short sides extending in the vertical direction of the power circuit board 133*a* and the louvers 137*a*2 and 137*a*3 are arranged along the lower long side extending in the horizontal direction to surround the power supply unit 133. Thus, outside air can enter an area of the power supply unit 133 from the outside of the image forming apparatus 100 via the through-holes between the louvers 137.

The power supply unit 133 includes the power circuit board 133*a* and a board support member 133*b* as electronic circuit boards. The power circuit board 133*a* is a low-voltage power circuit board having a substantially rectangular shape. The power circuit board 133*a* is mounted with many electronic elements including a large electronic element that generates heat mounted on the front surface and a short electronic element mounted on the back surface.

The power circuit board 133*a* is a low-voltage power circuit board that receives AC power from an external commercial power supply and converts the AC power into direct-current (DC) power. The power circuit board 133*a* includes a low-voltage power transformer, a heat sink, and an electrolytic capacitor as large-sized electronic components.

The board support member 133*b* is attached to the back surface of the power circuit board 133*a*. The power circuit board 133*a* is fixed to the right framework 132R via the board support member 133*b* so that the short sides of the power circuit board 133*a* are substantially vertical, the long sides thereof are substantially horizontal, and the back surface thereof faces outward of the image forming apparatus 100.

The drive unit 134 is provided with a motor as a driving source and a drive transmission member (not illustrated) including a gear, to enable transmission of driving force of the motor to the image forming unit 101.

On the other hand, a control circuit board 135 that controls operations is disposed on the outside of the left framework 132L. More specifically, a left outer surface member 130L and the left framework 132L are disposed to face each other, and the control circuit board 135 is attached to the left framework 132L between the left outer surface member 130L and the left framework 132L.

The outside of the framework 132, which includes the right framework 132R and the left framework 132L, is covered by the outer surface members 130 in this way. Such a structure reduces leakage of operating sound to the outside of the image forming apparatus 100, and prevents occurrence of an unintended air flow from anywhere other than the louvers 137*a*1 to 137*a*4 disposed on the outer surface members 130 to the inside of the image forming apparatus 100.

The image forming apparatus 100 includes a partition member 139, as illustrated in FIGS. 4 to 6. By combining the partition member 139 with the right outer surface member 130R, a first duct 140 is formed between the right outer surface member 130R and the right framework 132R. In other words, the power supply unit 133 is surrounded by the right framework 132R, the partition member 139, and the right outer surface member 130R to be separated from other components inside and outside the image forming apparatus 100.

One opening of the first duct 140 is connected to a space formed by the right framework 132R, the partition member 139, and the right outer surface member 130R, which surrounds the power supply unit 133. The other opening of the first duct 140 is connected to a suction port 141*a* of the blower apparatus (blower fan) 141 disposed vertically above the power supply unit 133 (FIGS. 4 to 7). Thus, the first duct 140 serves as a sealed air duct that connects between the space surrounding the power supply unit 133 and the blower fan 141.

A type of centrifugal fan is used as the blower fan 141 according to the present exemplary embodiment. The blower fan 141 is disposed so that rotary vanes is substantially horizontal. The suction port 141*a* is disposed in a direction of the first duct 140, i.e., vertically downward. More specifically, the blower fan 141 and the power circuit board 133*a* are disposed so that an image of the blower fan 141 projected from the vertical direction to a horizontal plane overlaps with an image of the power circuit board 133*a* projected from the vertical direction to the horizontal plane. An exhaust port 141*b* of the blower fan 141 is connected to cooling air outlet ports 143 from which air is blown toward an image forming surface of the recording material P that has passed through the discharge roller pair 127 and is just before being stacked on the discharge tray 129, as illustrated in FIG. 7. The present exemplary embodiment include a second duct 142 that constitutes a sealed air duct. One end of the second duct 142 is connected to the exhaust port 141*b* of the blower fan 141, and the other end thereof constitutes the cooling air outlet ports 143.

(Cooling Inside of Image Forming Apparatus 100)

In the image forming apparatus 100, the power circuit board 133*a* has a function of converting a commercial power supply into a predetermined voltage and current to operate the image forming apparatus 100. Since the power circuit board 133*a* is a heat source that generates heat at the time of conversion, the power circuit board 133*a* needs to be cooled.

Meanwhile, since the fixing unit 103 heats a toner image to fix it to the recording material P, the recording material P is hot immediately after image fixing. The recording material P may possibly be discharged to and stacked on the discharge tray 129 before the fixed toner cools and settles, resulting in stuck recording material P depending on the paper type and image condition. To prevent this, the recording material P immediately after discharge needs to be cooled with blown air.

In the present exemplary embodiment, the power circuit board 133*a* is cooled by using an air current generated on the upstream side of the blower fan 141, and the recording material P immediately after the image fixing is cooled by using an air current generated on the downstream side of the blower fan 141. A cooling operation for cooling the power circuit board 133*a* and the recording material P immediately after the image fixing will be described in detail below.

When power of the image forming apparatus 100 is turned on and the blower fan 141 is driven, a suction side on the upstream side of the suction port 141*a* provides a negative pressure. Thus, outside air flows into the vicinity of the power supply unit 133 from the louvers 137 disposed on the outer surface member 130 around the power supply unit 133 through the first duct 140 connected to the suction port 141*a*, as indicated by an arrow a (FIG. 6). The outside air flows along the front surface side of the power circuit board 133*a* as indicated by an arrow b to cool the electronic elements on the power circuit board 133*a* that is a first heat source component. As illustrated in FIG. 5, the louvers 137*a*1 to 137*a*4 are disposed in the vicinity of three sides other than the upper long side of the power circuit board 133*a*, and the first duct 140 is disposed in the vicinity of the upper long side. Thus, air currents (indicated by arrows b1, b2, b3, and b4) that are sucked from the louvers 137*a*1 to 137*a*4, respectively, flow short distances in average, making it possible to efficiently cool the entire power circuit board 133*a* with the air currents.

If a temperature rise of the electronic elements on the power circuit board 133*a* is uneven, it is desirable to decrease an opening area of the louver 137 corresponding to a portion having a small temperature rise and increase an opening area of the louver 137 corresponding to a portion having a large temperature rise. This enables adjusting the amount of outside air to be taken in via each of the louvers 137 to achieve a balance of cooling.

The air that has cooled the power circuit board 133*a* passes through the first duct 140, as indicated by the arrow c in FIGS. 5 and 6, and then is sucked by the blower fan 141. The sucked air is accelerated by the blower fan 141 and then sent to the second duct 142 connected to the exhaust side, which is on the downstream side of the exhaust port 141*b*. One end of the second duct 142 is connected to the exhaust port 141*b* of the blower fan 141, and the other end thereof constitutes the cooling air outlet ports 143 from which air is exhausted to the outside of the image forming apparatus 100. At this time, outside the image forming apparatus 100, the air exhausted from the cooling air outlet ports 143 is blown onto the image forming surface of the hot recording material P, which has been subjected to the image fixing and discharged from the discharge roller pair 127, as indicated by an arrow d, thus cooling the recording material P.

The air blown onto the recording material P from the cooling air outlet ports 143 of the second duct 142 is the air that has cooled the power circuit board 133*a*, and thus is hotter than outside air. However, the temperature of the air is sufficiently lower than the temperature of the recording material P immediately after being heated by the fixing unit 103 and the solidification temperature of toner melted by the fixing unit 103. Thus, the air cools the recording material P to prevent sticking of the recording materials P stacked on the discharge tray 129.

In this way, disposing the cooling target on each of the suction side on the upstream side of the blower fan 141 and the exhaust side on the downstream side thereof enables efficiently cooling a plurality of cooling targets by using one fan. This makes it possible to save space and cost without disposing a fan for each of the plurality of cooling targets or disposing a larger and more powerful fan while disposing a duct for branching an air flow. In addition, use of only one fan enables reducing a fan noise. By disposing the cooling targets before and after the fan, a distance from suction portions (the plurality of through-holes disposed via the louvers 137) disposed on the outer surface members 130 of the image forming apparatus 100 to the fan to be a noise source can be ensured. This also enables reducing the leakage of the operating sound to the outside of the image forming apparatus 100 and reducing a noise of the image forming apparatus 100.

While, in the first exemplary embodiment, one cooling target is disposed on each of the upstream and downstream sides of the blower apparatus 141, the cooling target to be disposed on each of the upstream and downstream sides is not limited to one. Further, the blower apparatus 141 may be configured to send air not only in the vicinity of the cooling targets but also in the vicinity of blowing targets for other applications.

An example of other applications is ventilation. In the electrophotographic process, the photosensitive drum 109 is charged to form an electrophotographic image. In the process, ozone is generated by corona discharge, and a discharge product such as nitrogen oxide (NOx) is generated in the image forming apparatus 100 and may adhere to the photosensitive drum 109. If the discharge product adheres to the photosensitive drum 109, moisture is likely to adhere thereto. As a result, the moisture on the photosensitive drum 109 causes a charge flow on the surface of the photosensitive drum 109, resulting in an image defect.

Thus, in a second exemplary embodiment, blowing targets that are cooling targets are disposed on the upstream and downstream sides of the blower apparatus 141 as in the first exemplary embodiment, and the photosensitive drum 109 is disposed as another blowing target on the downstream side of the blower apparatus 141 to prevent adhesion of a discharge product and occurrence of an image defect. A configuration of the present exemplary embodiment will be described in detail below.

Figure 8:
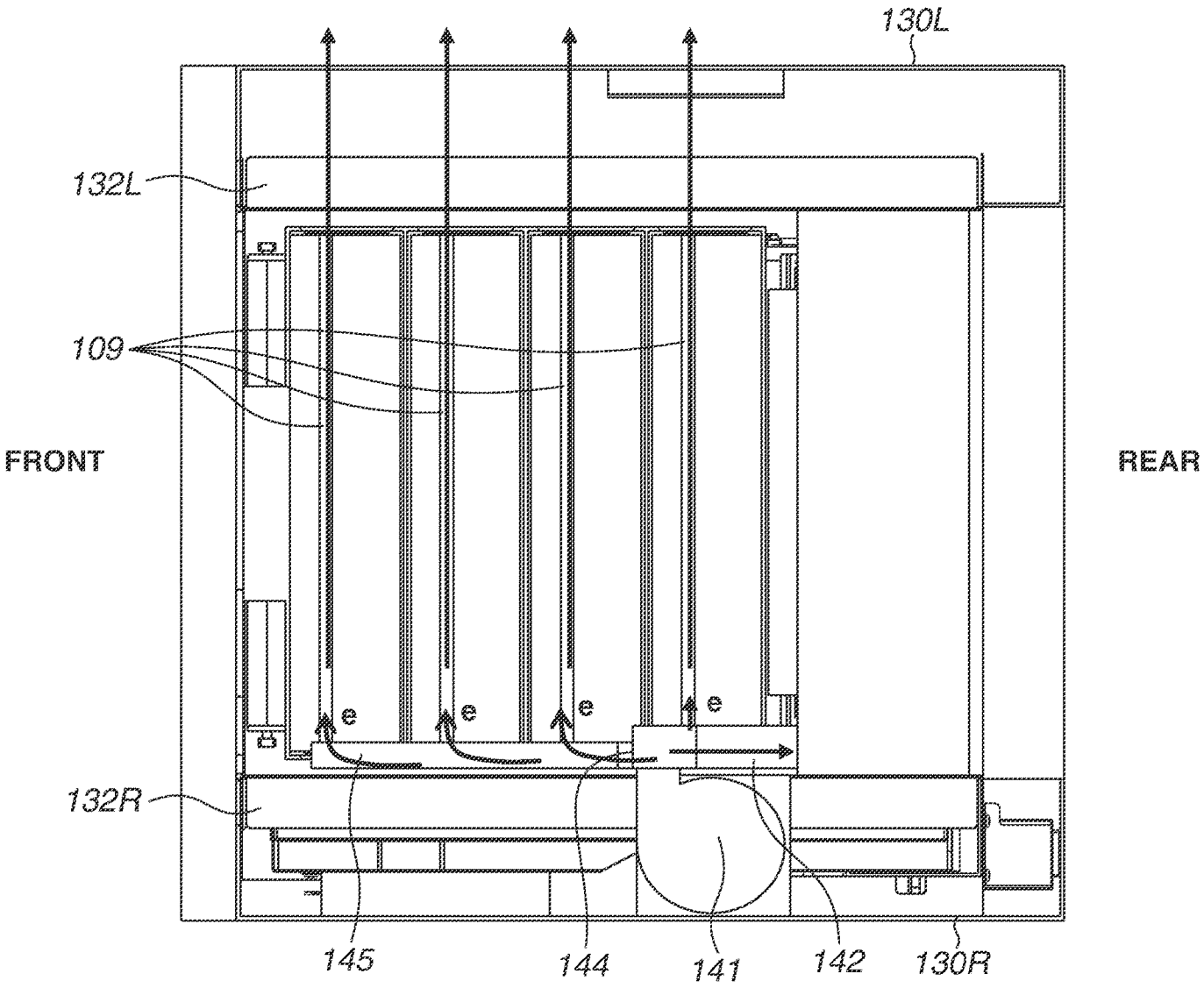
FIG. 8 illustrates air flows in the image forming apparatus according to the first exemplary embodiment.
Figure 9:
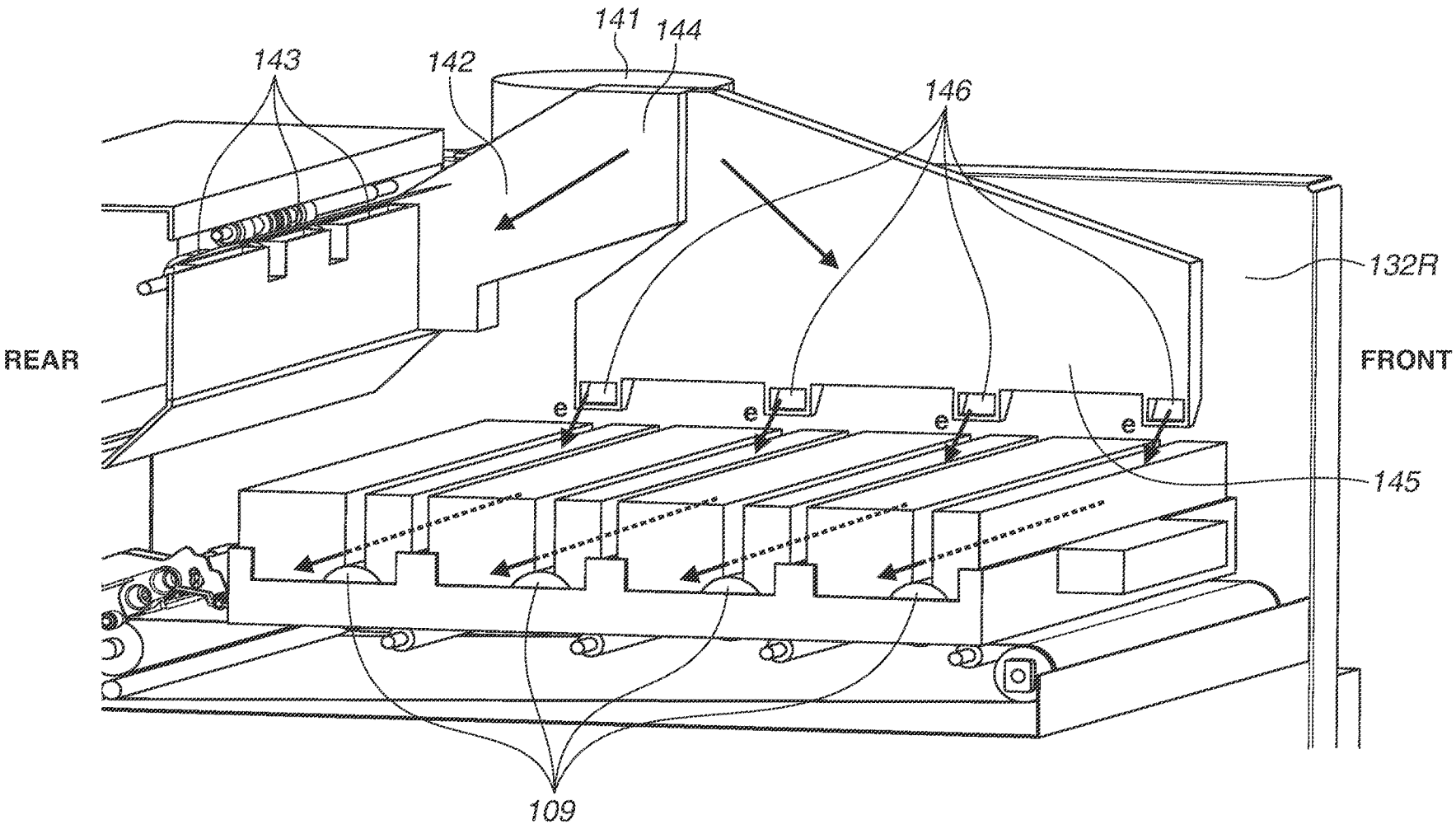
FIG. 9 is an exploded perspective view illustrating an image forming apparatus according to a second exemplary embodiment.

The second exemplary embodiment will be described below with reference to FIGS. 8 and 9. FIG. 8 is a top view illustrating the image forming apparatus 100 according to the second exemplary embodiment when the top outer surface member and the laser scanner are removed. FIG. 9 is an enlarged view illustrating the vicinity of a third duct added in the second exemplary embodiment. In the image forming apparatus 100 according to the second exemplary embodiment, the power supply unit 133 is disposed, and the first duct 140 and the blower fan 141 are disposed vertically above the power supply unit 133, as in the first exemplary embodiment. The exhaust port 141*b* of the blower fan 141 is connected with a second duct 142 that is different from the one according to the first exemplary embodiment. Unlike the second duct 142 according to the first exemplary embodiment, the second duct 142 is provided with a branch port 144 in addition to the cooling air outlet ports 143. The branch port 144 is connected with a third duct 145.

One end of the third duct 145 is connected to the branch port 144, and the other end thereof has a branching shape that constitutes four ventilation air outlet ports 146. The ventilation air outlet ports 146 are oriented toward the respective photosensitive drums 109 of the cartridges 105 for four colors, and air is blown to the photosensitive drums 109 as indicated by arrows e.

The left framework 132L is provided with holes (not illustrated) in the vicinity of the photosensitive drums 109.

The left outer surface member 130L disposed outside the left framework 132L is provided with louvers (not illustrated).

(Cooling Inside of Image Forming Apparatus 100)

The configurations and effects of the power circuit board 133*a*, the blower fan 141 for cooling the recording material P after the image fixing, the first duct 140, and the second duct 142 are similar to those according to the first exemplary embodiment.

When power of the image forming apparatus 100 is turned on and the blower fan 141 is driven, the suction side on the upstream side of the suction port 141*a* provides a negative pressure. Thus, outside air flows into the vicinity of the power supply unit 133 from the louvers 137 disposed on the outer surface member 130 around the power supply unit 133 through the first duct 140 connected to the suction port 141*a*, as indicated by the arrow a (FIG. 6). The outside air flows along the front surface side of the power circuit board 133*a* as indicated by the arrow b to cool the electronic elements on the power circuit board 133*a* that is a first heat source component.

The air that has cooled the power circuit board 133*a* passes through the first duct 140, as indicated by the arrow c in FIGS. 5 and 6, and then is sucked by the blower fan 141. The sucked air is accelerated by the blower fan 141 and then sent to the second duct 142 connected to the exhaust side, which is on the downstream side of the exhaust port 141*b*. One end of the second duct 142 is connected to the exhaust port 141*b* of the blower fan 141, and the other end thereof constitutes the cooling air outlet ports 143 from which air is exhausted to the outside of the image forming apparatus 100. At this time, outside the image forming apparatus 100, the air exhausted from the cooling air outlet ports 143 is blown onto the image forming surface of the hot recording material P, which has been subjected to the image fixing and discharged from the discharge roller pair 127, as indicated by an arrow d, thus cooling the recording material P.

In the present exemplary embodiment, on the other hand, the second duct 142 has the branch port 144 in addition to the cooling air outlet ports 143, and the air sucked by the blower fan 141 is sent to the third duct 145 connected to the branch port 144. One end of the third duct 145 is connected to the branch port 144, and the other end thereof constitutes the four ventilation air outlet ports 146. Air is blown to the photosensitive drums 109 of the cartridges 105 for four colors. This enables the image forming apparatus 100 to prevent the adhesion of a discharge product to the photosensitive drums 109 and the occurrence of an image defect.

Since the purpose of sending air from the third duct 145 is ventilation, an effect of preventing the occurrence of an image defect can be obtained without issue, even with warmed air after the power circuit board 133*a* is cooled.

Then, the air blown to the photosensitive drums 109 passes through the holes provided in the left framework 132L, passes between the left outer surface member 130L and the left framework 132L, and is discharged from the through-holes between the louvers disposed on the left outer surface member 130L to the outside of the image forming apparatus 100.

In this way, the cooling target is disposed on each of the suction side on the upstream side of the blower fan 141 and the exhaust side on the downstream side thereof, and the blowing target is disposed on the exhaust side on the downstream side of the blower fan 141. This enables efficiently utilizing the air current that can be generated by one fan. More specifically, this makes it possible to save space and cost without disposing a fan for each of the plurality of cooling and blowing targets or disposing a larger and more powerful fan. In addition, use of only one fan enables reducing a fan noise. By disposing the cooling and blowing targets before and after the fan, a distance from the louvers 137 that cover the openings of the image forming apparatus 100 to the fan as a noise source can be ensured. This also enables reducing the leakage of the operating sound to the outside of the image forming apparatus 100 and reducing a noise of the image forming apparatus 100.

(Modifications)

While, in the first and the second exemplary embodiments, the blower fan that is a type of centrifugal fan is used as the blower apparatus 141, the blower apparatus 141 is not limited thereto but may be an axial fan or a rotary fan.

In general, an axial fan can be introduced at a lower cost than a blower fan. However, since an axial fan provides a lower static pressure than a blower fan, a pressure loss of the air duct needs to be reduced, i.e., the air duct needs to be wide and short.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2020-180573, filed Oct. 28, 2020, which is hereby incorporated by reference herein in its entirety.

What is claimed is:

1. An image forming apparatus comprising:

an image forming unit configured to form an image on a recording material;

a stacking unit on which the recording material having the image formed on the recording material by the image forming unit is stacked;

a frame configured to support the image forming unit;

an outer surface member disposed on an outer side relative to the frame and having a through-hole;

an electronic circuit board disposed between the frame and the outer surface member; and a fan configured to suck air from an outside of the image forming apparatus to an inside of the image forming apparatus via the through-hole, wherein the electronic circuit board is disposed on an upstream side of the fan in a direction of an air flow generated into air by the fan, and wherein the stacking unit is disposed on a downstream side of the fan in the direction of the air flow generated by the fan.

2. The image forming apparatus according to claim 1, wherein the fan and the electronic circuit board are disposed so that an image of the fan projected from a vertical direction onto a horizontal plane overlaps with an image of the electronic circuit board projected from the vertical direction onto the horizontal plane.

3. The image forming apparatus according to claim 1, wherein the image forming unit includes a photosensitive drum for forming a toner image.

4. The image forming apparatus according to claim 3, wherein the photosensitive drum is disposed on the downstream side of the fan in the direction of the air flow generated by the fan.

5. The image forming apparatus according to claim 1, wherein the fan cools the recording materials stacked on the stacking unit by air that has cooled the electronic circuit board by sucking air from the outside of the image forming apparatus to the inside of the of the image forming apparatus.

6. The image forming apparatus according to claim 1, wherein the electronic circuit board includes a low-voltage power circuit configured to receive alternating-current (AC) power from an external commercial power supply and to convert the AC power into direct-current (DC) power.

7. An image forming apparatus comprising:

an image forming unit configured to form an image on a recording material;

a stacking unit on which the recording material having the image formed thereon by the image forming unit is stacked;

a frame configured to support the image forming unit;

an outer surface member disposed on an outer side relative to the frame and having a through-hole;

an electronic circuit board disposed between the frame and the outer surface member;

a fan configured to suck air from an outside of the image forming apparatus to an inside of the image forming apparatus via the through-hole;

a first duct disposed between the electronic circuit board and the fan;

a second duct disposed between the fan and an air outlet port configured to supply air to the recording material discharged to the stacking unit, wherein the fan sucks the air that has passed through the electronic circuit board and the first duct, and the fan supplies the sucked air to the recording material from the air outlet port through the second duct.

8. The image forming apparatus according to claim 7, wherein the fan and the electronic circuit board are disposed so that an image of the fan projected from a vertical direction onto a horizontal plane overlaps with an image of the electronic circuit board projected from the vertical direction onto the horizontal plane.

9. The image forming apparatus according to claim 7, wherein the image forming unit includes a photosensitive drum for forming a toner image.

10. The image forming apparatus according to claim 9, wherein the photosensitive drum is disposed on the downstream side of the fan in the direction of the air flow generated by the fan.

11. The image forming apparatus according to claim 7, wherein the electronic circuit board includes a low-voltage power circuit configured to receive alternating-current (AC) power from an external commercial power supply and to convert the AC power into direct-current (DC) power.

12. The image forming apparatus according to claim 7, wherein the fan is disposed above the electronic circuit board and the first duct in a vertical direction.

13. The image forming apparatus according to claim 12, wherein the image forming unit includes a plurality of cartridges below the fan in the vertical direction.

14. The image forming apparatus according to claim 13, further comprising a third duct between the fan and the plurality of cartridges, wherein the third duct includes a plurality of air outlet ports at respective positions corresponding to the plurality of cartridges.

* * * * *